US011402778B2

(12) United States Patent
Nishida et al.

(10) Patent No.: US 11,402,778 B2
(45) Date of Patent: Aug. 2, 2022

(54) IMAGE FORMING APPARATUS THAT SETS A TARGET TEMPERATURE FOR A FIXING UNIT BASED ON A MINIMUM NUMBER OF CONTINUOUS PIXELS IN A LINE

(71) Applicant: Canon Kabushiki Kaisha, Tokyo (JP)

(72) Inventors: Satoshi Nishida, Kanagawa (JP); Ryo Morihara, Tokyo (JP); Tomoo Akizuki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/124,826

(22) Filed: Dec. 17, 2020

(65) Prior Publication Data

US 2021/0191294 A1 Jun. 24, 2021

(30) Foreign Application Priority Data

Dec. 24, 2019 (JP) ..... JP2019-233016

(51) Int. Cl.
*G03G 15/20* (2006.01)
*G03G 15/01* (2006.01)
*G03G 15/00* (2006.01)

(52) U.S. Cl.
CPC ..... *G03G 15/205* (2013.01); *G03G 15/01* (2013.01); *G03G 15/2064* (2013.01);
(Continued)

(58) Field of Classification Search
CPC .. G03G 15/205; G03G 15/01; G03G 15/2064; G03G 15/5062; G03G 15/556;
(Continued)

(56) References Cited

U.S. PATENT DOCUMENTS 9,423,731 B2 8/2016 Tanaka et al.
10,067,448 B2 9/2018 Nishida
(Continued)

FOREIGN PATENT DOCUMENTS

EP 2708959 3/2014
JP 2006154413 A 6/2006
(Continued)

OTHER PUBLICATIONS

European Search Report dated May 27, 2021 in counterpart European Patent Appln. No. 20214822.7.

*Primary Examiner* — Walter L Lindsay, Jr.
*Assistant Examiner* — Laura Roth
(74) *Attorney, Agent, or Firm* — Venable LLP

(57) ABSTRACT

An image forming apparatus includes an image forming unit, a fixing unit, an image analyzer, and a temperature controller configured to control a temperature of the fixing unit in accordance to a target temperature. The image analyzer is configured to analyze image data for forming the toner image by the image forming unit, to evaluate a continuity of pixels of an image contained in the image data. The temperature controller is configured to change the target temperature based on analysis results of the image analyzer such that a value of the target temperature in a case where the image data contains an image with a continuity of pixels equal to or smaller than a predetermined value is higher than a value of the target temperature in a case where the image data contains no image with a continuity of pixels equal to or smaller than the predetermined value.

7 Claims, 15 Drawing Sheets

| IMAGE DENSITY | CORRECTION TEMPERATURE T1 | |
|---|---|---|
| | NO IMAGE WITH CONTINUITY OF PIXELS OF D1 OR LESS (S24A) | IMAGE WITH CONTINUITY OF PIXELS OF D1 OR LESS IS PRESENT (S24B) |
| EQUAL TO OR MORE THAN 101% | 0°C | +5°C |
| 100% | +5°C | +10°C |
| UNDER 100 % | +10°C | +15°C |

(52) U.S. Cl.
CPC ..... *G03G 15/5062* (2013.01); *G03G 15/556* (2013.01); *G03G 2215/00029* (2013.01); *G03G 2215/00063* (2013.01); *G03G 2215/2074* (2013.01)

(58) Field of Classification Search
CPC ..... G03G 2215/2074; G03G 15/5025; G03G 15/2039; G03G 2215/00029; G03G 2215/00063
See application file for complete search history.

(56) References Cited

U.S. PATENT DOCUMENTS

| | | | | |
|---|---|---|---|---|
| 2014/0016958 | A1 | 1/2014 | Yabuuchi et al. | |
| 2014/0072321 | A1* | 3/2014 | Ooyanagi | G03G 13/20 399/69 |
| 2019/0121268 | A1 | 4/2019 | Endo | |
| 2020/0310310 | A1* | 10/2020 | Shinji | G03G 15/2039 |

FOREIGN PATENT DOCUMENTS

| | | | | |
|---|---|---|---|---|
| JP | 200992688 | A | 4/2009 | |
| JP | 2011242645 | A * | 12/2011 | G03G 15/2039 |
| JP | 201525946 | A | 2/2015 | |

* cited by examiner

FIG.7

| IMAGE DENSITY | CORRECTION TEMPERATURE T1 | |
|---|---|---|
| | NO IMAGE WITH CONTINUITY OF PIXELS OF D1 OR LESS (S24A) | IMAGE WITH CONTINUITY OF PIXELS OF D1 OR LESS IS PRESENT(S24B) |
| EQUAL TO OR MORE THAN 101% | 0℃ | +5℃ |
| 100% | +5℃ | +10℃ |
| UNDER 100 % | +10℃ | +15℃ |

FIG.9

| IMAGE DENSITY | CORRECTION TEMPERATURE T1 | |
|---|---|---|
| | NO IMAGE WITH CONTINUITY OF PIXELS OF D1 OR LESS | IMAGE WITH CONTINUITY OF PIXELS OF D1 OR LESS IS PRESENT |
| EQUAL TO OR MORE THAN 101% | 0°C | -5°C |
| 100% | -5°C | -10°C |
| UNDER 100 % | -5°C | -10°C |

FIG.10

| | | FIRST EXPERIMENTAL IMAGE | SECOND EXPERIMENTAL IMAGE | THIRD EXPERIMENTAL IMAGE | FOURTH EXPERIMENTAL IMAGE |
|---|---|---|---|---|---|
| FIRST EXAMPLE | CORRECTION TEMPERATURE (°C) | 0 | 5 | 10 | 15 |
| | FIRST FIXABILITY EVALUATION | OK | OK | OK | OK |
| | SECOND FIXABILITY EVALUATION | OK | OK | OK | OK |
| | THIRD FIXABILITY EVALUATION | OK | OK | OK | OK |
| FIRST COMPARATIVE EXAMPLE | CORRECTION TEMPERATURE (°C) | 0 | 0 | 0 | 0 |
| | FIRST FIXABILITY EVALUATION | OK | OK | OK | OK |
| | SECOND FIXABILITY EVALUATION | OK | OK | OK | OK |
| | THIRD FIXABILITY EVALUATION | OK | N/A | N/A | N/A |
| SECOND COMPARATIVE EXAMPLE | CORRECTION TEMPERATURE (°C) | 0 | -5 | -5 | -10 |
| | FIRST FIXABILITY EVALUATION | OK | OK | OK | OK |
| | SECOND FIXABILITY EVALUATION | OK | OK | OK | OK |
| | THIRD FIXABILITY EVALUATION | OK | N/A | N/A | N/A |

FIG.13

| IMAGE DENSITY | CORRECTION TEMPERATURE T1 | |
|---|---|---|
| | NO TEXT IMAGE OF 30 POINTS OR LESS (S44A) | TEXT IMAGE OF 30 POINTS OR LESS IS PRESENT (S44B) |
| EQUAL TO OR MORE THAN 101% | 0℃ | +5℃ |
| 100% | +5℃ | +10℃ |
| UNDER 100 % | +10℃ | +15℃ |

FIG.14A

| IMAGE DENSITY | CORRECTION TEMPERATURE T1 (FIRST FIXING MODE) | |
|---|---|---|
| | NO IMAGE WITH CONTINUITY OF PIXELS OF D1 OR LESS | IMAGE WITH CONTINUITY OF PIXELS OF D1 OR LESS IS PRESENT |
| EQUAL TO OR MORE THAN 101% | 0℃ | +5℃ |
| 100% | +5℃ | +10℃ |
| UNDER 100 % | +10℃ | +15℃ |

FIG.14B

| IMAGE DENSITY | CORRECTION TEMPERATURE T1 (SECOND FIXING MODE) | |
|---|---|---|
| | NO IMAGE WITH CONTINUITY OF PIXELS OF D1 OR LESS | IMAGE WITH CONTINUITY OF PIXELS OF D1 OR LESS IS PRESENT |
| EQUAL TO OR MORE THAN 101% | 0℃ | -5℃ |
| 100% | -5℃ | -10℃ |
| UNDER 100 % | 0℃ | -5℃ |

FIG.15

| IMAGE DENSITY | CORRECTION TEMPERATURE T1 | |
|---|---|---|
| | NO TEXT IMAGE OF 30 POINTS OR LESS | TEXT IMAGE OF 30 POINTS OR LESS IS PRESENT |
| FULL-COLOR MODE | 0℃ | 5℃ |
| MONOCHROME MODE | +10℃ | +15℃ |

IMAGE FORMING APPARATUS THAT SETS A TARGET TEMPERATURE FOR A FIXING UNIT BASED ON A MINIMUM NUMBER OF CONTINUOUS PIXELS IN A LINE

BACKGROUND OF THE INVENTION

Field of the Invention

The present invention relates to an image forming apparatus configured to form an image on a recording material.

Description of the Related Art

A toner image formed on a photosensitive member is transferred onto a recording material and is then heated in a fixing apparatus to fix the toner image onto the recording material in an electro-photographic image forming apparatus. Lately, in order to response to an energy-saving request, power consumption of an image forming apparatus is tried to be cut by setting a fixing temperature low within a range in which minimum fixability of an image on a recording material is assured.

Japanese Patent Application Laid-open Nos. 2006-154413, 2009-92688 and 2015-25946 describe about increasing the fixing temperature in a case of outputting an image containing an area where a toner deposition amount (toner application amount) is locally large, by analyzing image data for a toner amount per pixel, or by analyzing print data described by page description language (PDL). There are also known such technologies of lowering the fixing temperature by using toner with low melting point or by forming a toner image by a thinnest-possible layer.

Hitherto, fixability of an image on a recording material has been evaluated in terms of a missing image caused by friction among recording materials or of whether offset to a fixing member exists, for example, and durability against an eraser such as a rubber eraser has not been taken into consideration. However, if the fixing temperature is set low within the range meeting with the conventional evaluation standard for the fixability in order to improve energy saving property, an image may be lost by frictional heat or a shearing force of the rubber eraser when erasing is performed.

SUMMARY OF THE INVENTION

The present invention provides an image forming apparatus which can form an image with high durability against an eraser and can save energy consumption.

According to one aspect of the invention, an image forming apparatus includes an image forming unit configured to form a toner image on a recording material, a fixing unit configured to heat the toner image formed on the recording material by the image forming unit to fix the toner image to the recording material, an image analyzer configured to analyze image data for forming the toner image by the image forming unit, to evaluate a continuity of pixels of an image contained in the image data, and a temperature controller configured to control a temperature of the fixing unit in accordance to a target temperature, and to change the target temperature based on analysis results of the image analyzer such that a value of the target temperature in a case where the image data contains an image with a continuity of pixels equal to or smaller than a predetermined value is higher than a value of the target temperature in a case where the image data contains no image with a continuity of pixels equal to or smaller than the predetermined value.

According to another aspect of the invention, an image forming apparatus includes an image forming unit configured to form a toner image on a recording material, a fixing unit configured to heat the toner image formed on the recording material by the image forming unit to fix the toner image to the recording material, an image analyzer configured to analyze a type of an image contained in image data for forming the toner image by the image forming unit, and a temperature controller configured to control a temperature of the fixing unit in accordance to a target temperature, and to change the target temperature based on analysis results of the image analyzer such that a value of the target temperature in a case where the image data contains a text image is higher than a value of the target temperature in a case where the image data contains no text image.

According to still another aspect of the invention, an image forming apparatus includes an image forming unit configured to form a toner image on a recording material and switchable between a monochrome mode for forming the toner image by using a toner of a single color and a full-color mode for forming the toner image by using toners of plural colors, a fixing unit configured to heat the toner image formed on the recording material to fix the toner image to the recording material, and a temperature controller configured to control a temperature of the fixing unit in accordance to a target temperature, and to change the target temperature such that a value of the target temperature in a case of forming an image in the monochrome mode is higher than a value of the target temperature in a case of forming an image in the full-color mode.

Further features of the present invention will become apparent from the following description of exemplary embodiments with reference to the attached drawings.

BRIEF DESCRIPTION OF THE DRAWINGS

FIG. 7 illustrates a correction temperature determining table of the first example.

FIG. 9 illustrates a correction temperature determining table of a fixing temperature of a second comparative example in experiments.

FIG. 10 is a table indicating results of the experiments.

FIG. 13 illustrates a correction temperature determining table of the second example.

FIG. 14A illustrates a correction temperature determining table for a first fixing mode of a third example.

FIG. 14B illustrates another correction temperature determining table for a second fixing mode of the third example.

FIG. 15 illustrates a correction temperature determining table of a fourth example.

DESCRIPTION OF THE EMBODIMENTS

An exemplary embodiment of the present disclosure will be described below with reference to the drawings.

Image Forming Apparatus

Figure 1:
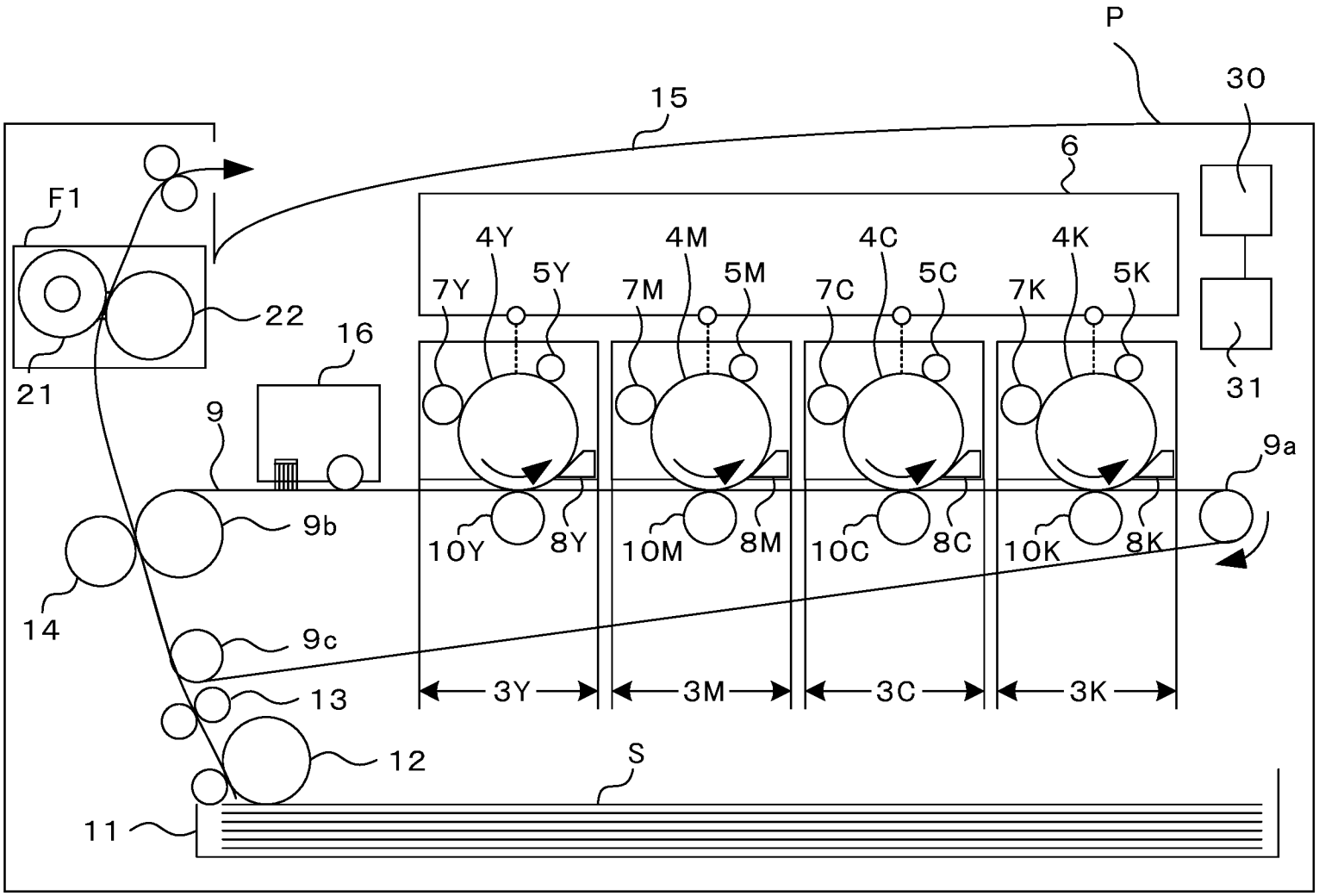
FIG. 1 is a schematic diagram illustrating an image forming apparatus according to an exemplary embodiment of the present disclosure.

Firstly, an image forming apparatus according to exemplary embodiments of the present disclosure will be described. FIG. 1 is a schematic diagram of the image forming apparatus P used in the present exemplary embodiment. The image forming apparatus P is a tandem-type intermediate transfer type electro-photographic apparatus including four image forming stations 3Y, 3M, 3C and 3K arrayed approximately straightly and an intermediate transfer belt 9. The image forming station 3Y serves as an image forming unit to form an image of yellow (abbreviated as Y hereinafter). Similarly to that, the image forming stations 3M, 3C and 3K serve as image forming units respectively to form images of magenta (M), cyan (C) and black (K).

The respective image forming stations 3Y, 3M, 3C and 3K include drum type electronic photosensitive members (referred to as photosensitive drums hereinafter) 4Y, 4M, 4C and 4K serving as image bearing members and charging rollers 5Y, 5M, 5C and 5K serving as charging units. The respective image forming stations 3Y, 3M, 3C and 3K also include developers 7Y, 7M, 7C and 7K serving as developing units and cleaning units 8Y, 8M, 8C and 8K serving as cleaning units. Still further, an exposing unit 6 configured to expose the photosensitive drums 4Y, 4M, 4C and 4K of the image forming stations 3Y, 3M, 3C and 3K is disposed above the image forming stations 3Y, 3M, 3C and 3K.

Based on information received from an external device not illustrated such as a host computer, a video controller 30 transmits a print command and an image signal to a control portion 31. At this time, the video controller 30 analyzes the received information and transmits a resultant image signal of bit-mapped character code or of halftoning process by dither or the like of a halftone image to the control portion 31.

As the control portion 31 receives the image signal, the image forming apparatus P starts an image forming operation. In the image forming operation, the respective image forming stations 3Y, 3M, 3C and 3K start toner image forming processes.

Firstly, the photosensitive drum 4Y is rotated in a direction of an arrow in the image forming station 3Y. An outer circumferential face, i.e., a surface, of the photosensitive drum 4Y is homogeneously charged by the charging roller 5Y. The charged surface of the photosensitive drum 4Y is exposed to irradiation of a laser beam modulated correspondingly to the image signal from the exposure unit 6 and an electrostatic latent image is formed thereon. The latent image is developed by the developer 7Y by using yellow toner. Thus, a yellow toner image is formed on the surface of the photosensitive drum 4Y Similar image forming processes are performed also in the image forming stations 3M, 3C and 3K. Thereby, a magenta toner image, a cyan toner image and a black toner image are formed respectively on the surfaces of the photosensitive drums 4Y, 4M, 4C and 4K.

The intermediate transfer belt 9 is an endless member provided along an array direction of the image forming stations 3Y, 3M, 3C and 3K and is stretched around a driving roller 9*a* and driven rollers 9*b* and 9*c*. The driving roller 9*a* rotates in a direction of an arrow in FIG. 1. Thereby, the intermediate transfer belt 9 is rotated and is moved with a speed of 100 mm/sec along the respective image forming stations 3Y, 3M, 3C and 3K.

Primary transfer rollers 10Y, 10M, 10C and 10K are disposed along an outer circumferential face, i.e., a surface, of the intermediate transfer belt 9 so as to face the photosensitive drums 4Y, 4M, 4C and 4K across the intermediate transfer belt 9. The primary transfer rollers 10Y, 10M, 10C and 10K serve as primary transfer portions that transfer the toner images of the respective colors by sequentially superimposing onto the intermediate transfer belt 9. Thereby, a four color full-color toner image is formed on the surface of the intermediate transfer belt 9.

After the primary transfer, adhesives such as transfer residual toner or the like left on the surfaces of the photosensitive drums 4Y, 4M, 4C and 4K are removed by a cleaning blades not illustrated and provided in the cleaning units 8Y, 8M, 8C and 8K. Thereby, the photosensitive drums 4Y, 4M, 4C and 4K are ready for a next image forming process.

Meanwhile, a recording material S stacked and stored in a sheet feed cassette 11 provided at a lower part of an apparatus body of the image forming apparatus P is separated and delivered one by one out of the sheet feed cassette 11 by a feed roller 12 and is fed to a registration roller pair 13. The registration roller pair 13 sends the recording material S fed as described above to a transfer nip portion between the intermediate transfer belt 9 and a secondary transfer roller 14. Note that various sheet members having different sizes and materials such as a sheet of paper such as a plain paper and a thick paper, a plastic film, a cloth, a surface-treated sheet such as a coated paper and a special shape sheet such as an envelope and an index sheet can be used for the recording material S.

The secondary transfer roller 14 is disposed so as to face the driven roller 9*b* across the intermediate transfer belt 9. A bias is applied to the secondary transfer roller 14 from a high voltage power source not illustrated when the recording material S passes through the transfer nip portion. Thereby, the full-color toner image is secondarily transferred from the intermediate transfer belt 9 to the recording material S passing through the transfer nip portion. The image forming stations 3Y, 3M, 3C and 3K, the intermediate transfer belt 9 and the secondary transfer roller 14 described above compose an image forming unit of the present exemplary embodiment for forming the toner image on the recording material S. Adhesives such as transfer residual toner left on the surface of the intermediate transfer belt 9 after the secondary transfer are removed by an intermediate belt cleaning unit 16. Note that while the intermediate transfer type image forming unit has been illustrated here, a direct transfer type electro-photographic unit may be used as the image forming unit.

The recording material S onto which the toner image has been transferred is conveyed to a fixing apparatus F1. The recording material S is heated and pressed as the recording material S passes through the fixing apparatus F1. Thereby, as the toner composing the toner image is melted and is then cooled and solidified, the toner image is fixed, i.e., is solidified, onto the recording material S. The recording material S which has passed through the fixing apparatus F1 is discharged to a discharge tray 15 out of the image forming apparatus P.

Fixing Apparatus

Next, the fixing apparatus F1 serving as a fixing unit of the present exemplary embodiment will be described. In the following description, a "longitudinal direction" regarding the fixing apparatus F1 and members composing the fixing apparatus F1 refers to a direction orthogonal to a recording material conveyance direction, i.e., a main scan direction in forming an image, among directions along the surface of the recording material. A "short direction" refers to a direction parallel to the recording material conveyance direction among the directions along the surface of the recording material. A "width" is a size in the short direction. Regarding the recording material, a "longitudinal width" refers to a size of the recording material in a longitudinal direction.

Figure 2:
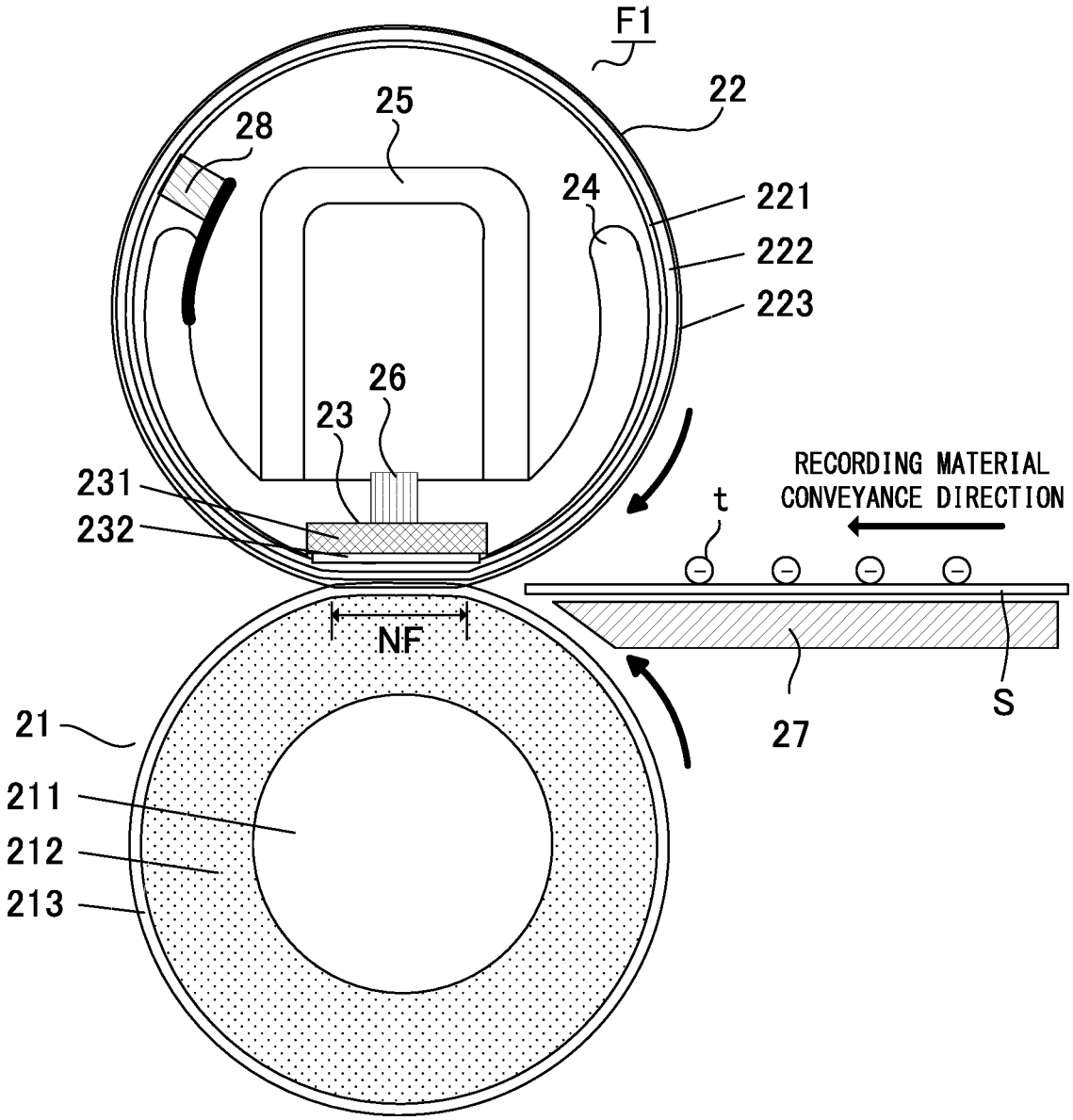
FIG. 2 is a section view of a fixing apparatus according to the exemplary embodiment of the present disclosure.

FIG. 2 is a schematic diagram illustrating a section vertical to the longitudinal direction, i.e., a transverse section view, of the fixing apparatus F1. The fixing apparatus F1 rotationally drives a pressure roller 21 facing a fixing film 22 and serving as a counter member, i.e., as a pressing member, forming a nip portion together with the fixing film 22 for nipping and conveying the recording material being pressed. The pressure roller 21 rotates the fixing film 22 by a conveyance force thereof. That is, the fixing apparatus F1 is a so-called tensionless type apparatus of a so-called film heating type and pressure roller driving type.

The fixing apparatus F1 of the present exemplary embodiment includes the pressure roller 21 serving as the pressing member, the fixing film 22 serving as a fixing member, a heater 23 serving as a heating member, a heater holder 24 serving as a holding member and a rigid stay 25 serving as a rigid member. All of the pressure roller 21, the fixing film 22, the heater 23, the heater holder 24 and the rigid stay 25 are long members extending in the longitudinal direction.

The heater 23 includes a ceramic substrate 231 which extends in the longitudinal direction and which has heat resistance, thermal insulation and favorable heat conductivity. Then, a resistance heating element not illustrated is formed along the longitudinal direction of the substrate at a center part in the short direction of a front side, i.e., the pressure roller 21 side, of the substrate 231. Power supply electrodes not illustrated for supplying power to the resistance heating element are provided on inner sides of both end portions in the longitudinal direction of the substrate 231. Then, a heat resistant overcoat layer 232 is provided on the front side of the substrate 231 so as to cover a surface of the resistance heating element not illustrated.

The fixing film 22 is formed cylindrically by a flexible heat resistant resin material. A length of an outer circumference of the fixing film 22 is 57 mm. The fixing film 22 includes a polyimide layer of 50 microns thick as a cylindrical base layer 221 and an elastic layer 222 formed of silicon rubber of 200 microns thick around the base layer 221. Then, the fixing film 22 includes a release layer 223 formed of a fluorocarbon resin of 15 microns thick around the elastic layer 222.

The fixing film 22 is formed such that an inner circumference length thereof is greater than a length for encircling an outer circumference of the heater holder 24 holding the heater 23 by 3 mm. Then, the fixing film 22 is externally and loosely fitted to the heater holder 24 holding the heater 23 with a margin in terms of the circumference length. That is, the fixing film 22 encloses the heater 23.

The rigid stay 25 is formed of a rigid member formed into a downwardly opened U shape in terms of a transverse section thereof. The rigid stay 25 is disposed at a center in the short direction of an upper surface of the heater holder 24.

In FIG. 2, the pressure roller 21 includes a round-shaft shaped core metal 211, an elastic layer 212 formed of silicon rubber formed concentrically with the core metal 211 around the core metal 211 and a release layer 213 formed of a conductive fluorocarbon resin around the elastic layer 212. An outer circumference length of the pressure roller 21 is 63 mm. Note that the elastic layer 212 may be formed of foaming heat resistant rubber such as fluorocarbon rubber or silicon rubber. The release layer 213 may be also an insulating fluorocarbon resin.

The pressure roller 21 is disposed in parallel with the fixing film 22 under the fixing film 22 and is held by bearing members such that both end portions in the longitudinal direction of the core metal 211 are freely rotatable. Then, the core metal 211 of the pressure roller 21 and the rigid stay 25 are pressed by pressure springs not illustrated at the both longitudinal end portions such that an outer circumferential face, i.e., a surface, of the pressure roller 21 comes into contact with an outer circumferential face, i.e., a surface, of the fixing film 22. The surface of the pressure roller 21 is brought into contact with the surface of the fixing film 22 and a nip portion NF with a predetermined width for nipping and conveying the recording material S is formed between the surface of the pressure roller 21 and the surface of the fixing film 22 by the pressure force. A total pressure of the pressing force is 20 kgf.

The control portion 31 serving as a rotation control portion or as a drive control portion for controlling the rotation of the pressure roller 21 rotates the pressure roller 21 in a direction of an arrow with a peripheral speed, i.e., a process speed, of 100 mm/sec as illustrated in FIG. 2 corresponding to a print command. At this time, a rotational force acts on the fixing film 22 by a frictional force between the surface of the pressure roller 21 and the surface of the fixing film 22 at the nip portion NF. Due to that, the fixing film 22 is driven and rotated by the rotational force around the heater holder 24 in a direction of an arrow such that the inner circumferential face of the fixing film 22 is in close contact with and slides along the heater 23.

At this time, the rotation of the fixing film 22 is guided by the outer circumferential face of the heater holder 24 formed along an inner circumferential shape of the fixing film 22. Thereby, the rotation of the fixing film 22 is stabilized, and the fixing film 22 rotates while drawing same rotation tracks. The control portion 31, which serves also as a temperature controller (also serving as a power supply control portion or a heating control portion) for controlling a temperature of the fixing apparatus F1, supplies power to the resistance heating element corresponding to the print command. As the power is supplied, the heater 23 rises its temperature and heats the fixing film 22.

The temperature of the heater 23 is detected by a temperature detecting element 26 such as a thermistor provided as a temperature detecting unit on a back side of the substrate 231 of the heater 23. The control portion keeps the nip portion NF at a predetermined target temperature, i.e., a heating temperature to which heating control is performed, by controlling power supply to the resistance heating element not illustrated so that the heater 23 keeps the predetermined target temperature based on an output signal of the temperature detecting element 26. The target temperature during normal printing is set to be within a range of 120° C. to 230° C.

In a state in which the rotations of the pressure roller 21 and the fixing film 22 are stabilized and in which the temperature of the heater 23 is kept at the target temperature, the recording material S bearing a non-fixed toner image t is led into the nip portion NF by being guided by an entrance guide 27. The recording material S is nipped and conveyed by the surfaces of the pressure roller 21 and the surface of the fixing film 22 at the nip portion NF. During that conveyance process, heat and pressure of the fixing film 22 are applied to the recording material S, and the toner image t is heated and fixed onto the surface of the recording material S. The recording material S onto which the toner image t has been heated and fixed is separated curvedly from the surface of the fixing film 22 and is discharged out of the nip portion NF.

Control Circuit

Figure 3:
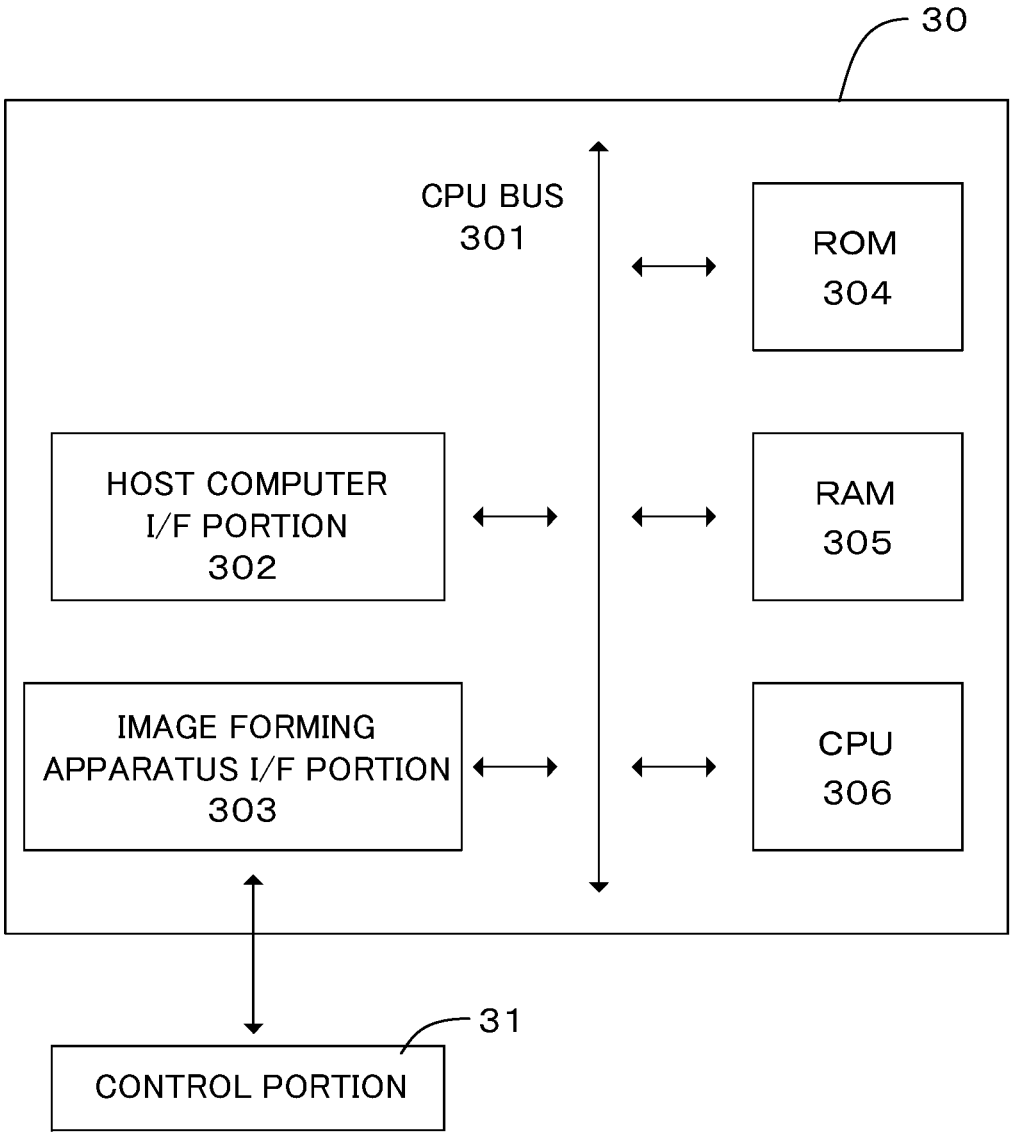
FIG. 3 is a block diagram illustrating a control structure of the image forming apparatus of a first example.

Next, a control configuration of the image forming apparatus P centered on the control of the fixing apparatus F1 will be described. FIG. 3 illustrates a system configuration of the video controller 30. The video controller 30 includes devices such as a host computer interface portion 302, an image forming apparatus interface portion 303, a ROM 304, a RAM 305 and a CPU 306 mutually connected through a CPU bus 301. The CPU bus 301 includes address, data and control buses.

The host computer interface portion 302 has a function of communicating bilaterally with an external device, i.e., a data transmitter, such as a host computer. The image forming apparatus interface portion 303 has a function of communicating bilaterally also with a control portion 31 of the image forming apparatus P. The video controller 30 and the control portion 31 cooperatively function as a control circuit for controlling the image forming apparatus P of the present exemplary embodiment.

The ROM 304 stores control program codes for executing image data processing and other processing described later. The RAM 305 stores rendering resultant bit map data of image data received by the image forming apparatus interface portion 303, image density information, a temporary buffer area and various processing statuses. The CPU 306 controls each device connected with the CPU bus 301 based on the control program code stored in the ROM 304.

The video controller 30 has a function of an image processing unit that generates an image signal for forming an image based on print data received from the external device. The video controller 30 has also a function of an image analyzer that analyzes the received print data and obtains density information and continuity information of the toner image. Note that these functional parts of the video controller 30 may be mounted as a hardware circuit such as ASIC independent of the CPU 306 or may be mounted in software as function modules of a control program executed by the CPU 306 and others.

First Example

Figure 4:
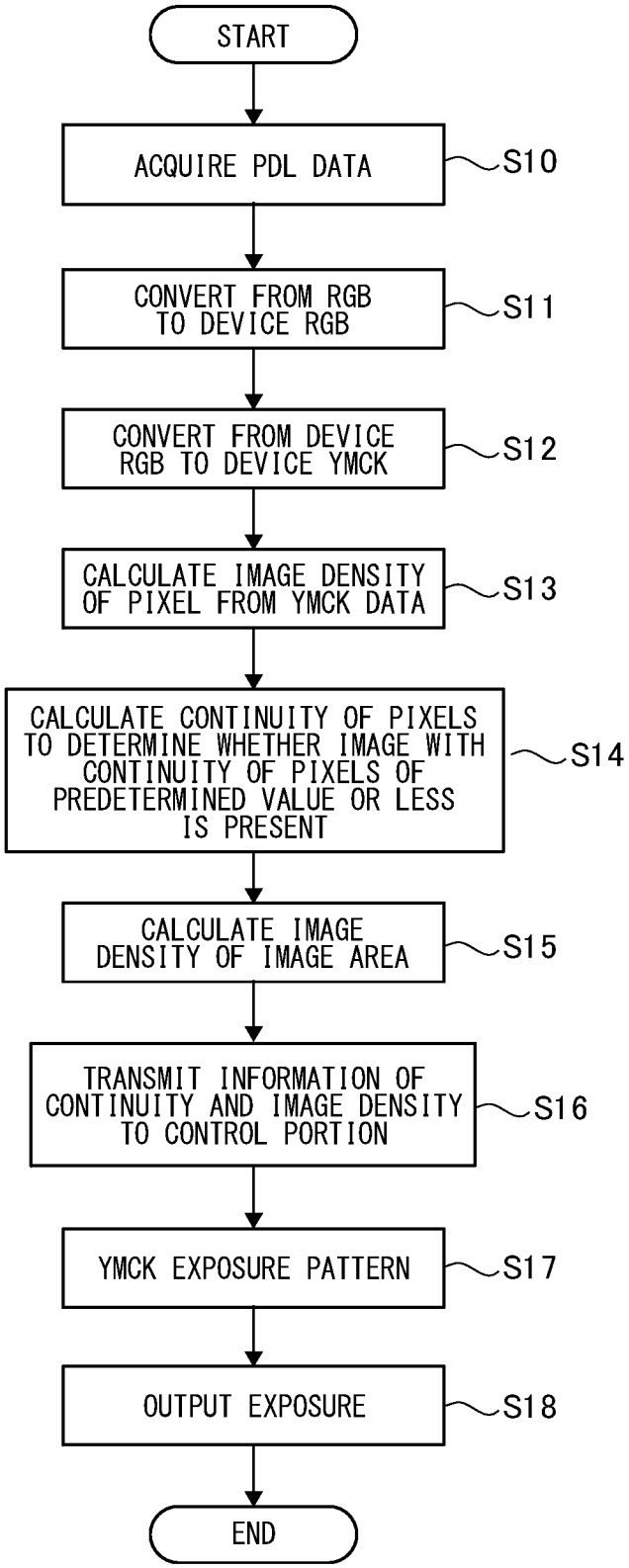
FIG. 4 is a flowchart illustrating a processing flow of image data in the first example.

Operations and a control method of the image forming apparatus P of a first example of the present exemplary embodiment will be described below. FIG. 4 illustrates an image data processing flow executed by the video controller 30. At first, image data and print data described in page description language (PDL), i.e., PDL data, for providing printing conditions of the image data are transmitted from the host computer in Step S10.

The video controller 30 converts the image data, i.e., the input image data, described in the PDL into image data for printing, i.e., into bit map data. In a case where the input image data is a color image, it is necessary to be converted into color data reproducible by the image forming apparatus P. For example, in a case where the input image data has color information in RGB (Red, Green and Blue) form, the image data is converted and is allotted to device RGB data reproducible by the image forming apparatus P in Step S11.

Next, the color information of the image data is converted from the device RGB data to device YMCK (yellow, magenta, cyan and black) data in Step S12. The YMCK data indicates a ratio of, a toner amount to be applied on a recording material by the image forming stations 3Y, 3M, 3C and 3K for forming a toner image of this time to a toner amount to be applied on the recording material when the image forming stations 3Y, 3M, 3C and 3K form a toner image in maximum density, by a value of 0% to 100% for each toner color. That is, in a case where the values of the YMCK data are 100%, toner images in the maximum density are formed by performing exposing process by fully lighting the exposure unit 6 in the corresponding image forming station. In a case where any of the values of the YMCK data is 0%, the exposure unit 6 is fully turned off in the corresponding image forming station and no toner image is formed, i.e., a toner amount is 0. An exposure amount of each color of YMCK is calculated by using a gradation table indicating a relationship between the exposure amount of each color and an actually applied toner amount with respect to the YMCK data.

In Steps S13 through S15, the video controller 30 analyzes the YMCK data and extracts information featuring the image data of this time.

At first, the video controller 30 calculates image density of each pixel in Step S13. That is, the video controller 30 functions here as a density information acquiring portion for acquiring density information of the toner image. For instance, in a case where the YMCK data is Y=50%, M=70%, C=20% and K=0%, the image density turns out to be 140% (=50+70+20+0).

A relationship between the density information and the toner amount on the recording material S will be described. The density information of pixel is a total value of the YMCK data for the corresponding pixel as described above. The density information for a specific area refers to a maximum value of density information of pixels composing that area. In the present example, a minimum value of the density information is set to be 0% and a maximum density is set to be 200%. The density information correlates with an actual toner amount per unit area on the recording material S. The toner amount per unit area on the recording material S when the density information is 100% is 0.45 mg/cm$^2$, for example. The toner amount per unit area on the recording material S when the density information is 200% is 0.90 mg/cm$^2$, for example.

Next, the video controller 30 calculates a continuity of pixels and judges whether an image in which the continuity of pixels is low exists in Step S14. That is, the video controller 30 functions as an acquisition portion for acquiring the continuity of pixels in the present example.

The video controller 30 analyzes the continuity of pixels based on binary image data binarized depending on whether a toner image exists on each pixel. For instance, it is 0 if there is no image on the pixel, i.e., a toner amount is 0, and is 1 if there is an image on the pixel, i.e., a toner amount other than 0. In other words, a pixel having a value of 1 in the binary image data represents that toner is to be applied for forming the toner image.

Figure 5A:
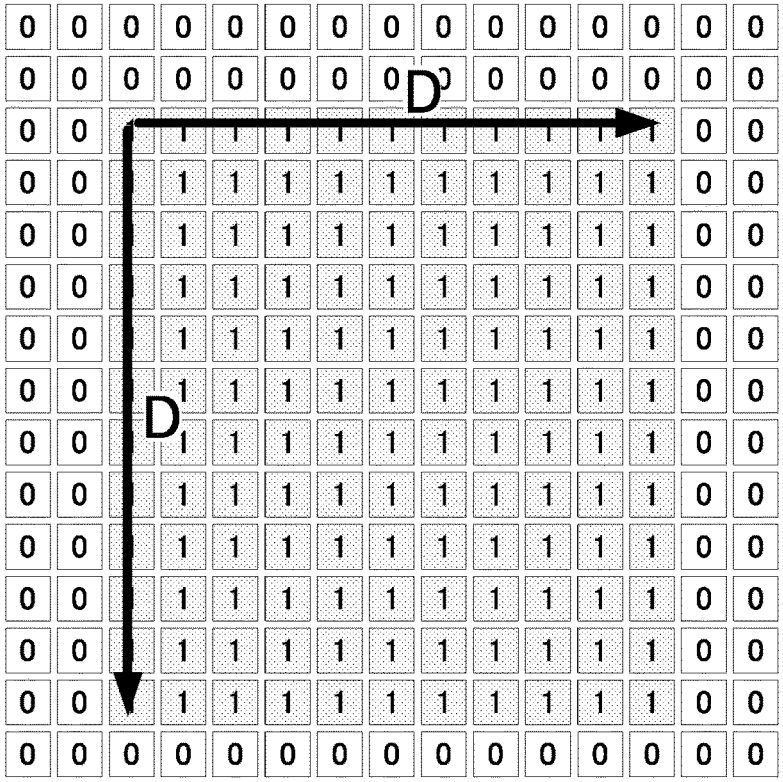
FIG. 5A is a chart for describing a definition of a continuity of pixels in the first example.
Figure 5B:
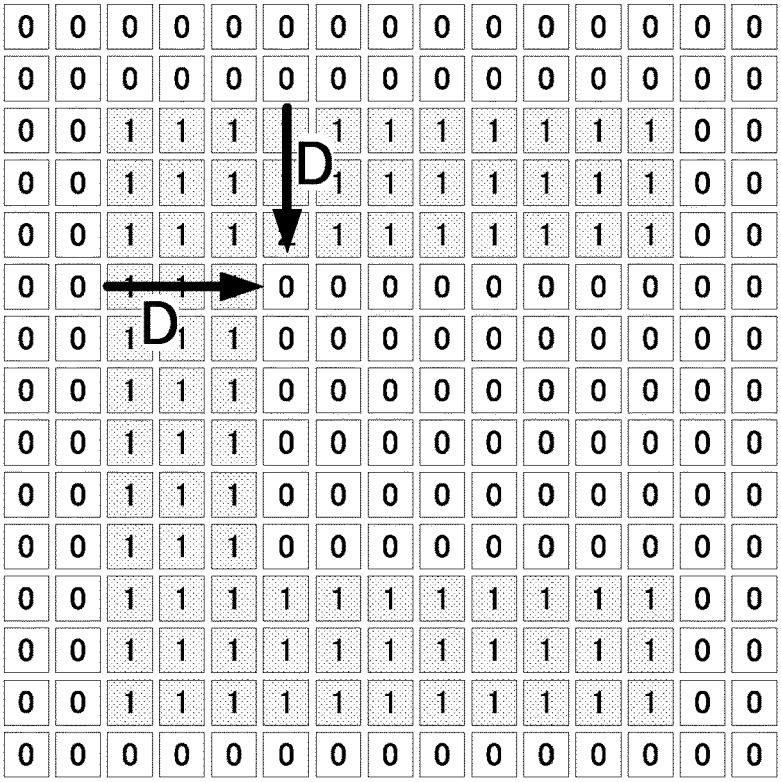
FIG. 5B is another chart for describing the definition of the continuity of pixels in the first example.

FIGS. 5A and 5B are tables describing a definition of the continuity of pixels and a method for acquiring the continuity of pixels. Each square block to which 0 or 1 is allotted indicates each pixel in the binary image data.

The continuity of pixels in the present example refers to a minimum value of a number of continuous pixels, where the number of continuous pixels is defined as a number of pixels in which the value of '1' continues in a vertical direction or a horizontal direction for an image area in which the pixels of '1' are connected in the binary image data. In FIGS. 5A and 5B, the continuity of pixels in each image refers to a width, i.e., a number of continuous pixels, indicated by D. Accordingly, the image in FIG. 5A has a high continuity of pixels as compared to that in the image in FIG. 5B. In general, images representing shapes or photographs have a large continuity of pixels and images representing line drawings or texts have a small continuity of pixels.

Next, a method for judging whether an image with a small continuity of pixels is present will be described. The image with a small continuity of pixels refers to an image with a continuity of pixels which is equal to or less than a predetermined value. For instance, a criterion, i.e., a predetermined value, for judging whether the continuity of pixels is small is set at 0.4 mm. If a resolution of the input image data is 600 dpi at this time, a size of one pixel is about 0.04 mm square, and 10 pixels correspond to about 0.4 mm.

It is possible to judge whether there exists an image with a continuity of pixels of 10 pixels or less than 10 pixels in the binary image data, as follows. At first, a pixel of 0, i.e., there is no image, and a neighboring pixel of 1, i.e., there is an image, are detected. Then, on the basis of the pixel of 1, it is confirmed whether a next pixel is 0 or 1. If the next pixel is 1, a further next pixel is confirmed. This process is repeated until the pixels of 1 continue by 10 or until a pixel of 0 is confirmed next. Then, how many the pixels of 1 has continued is counted. It can be seen that there is an image with a continuity of pixels of 10 pixels or less than 10 pixels if there is a pixel of 0 within 11 pixels. That is, the image data includes an image such as a thin line and/or a text having a width of 0.4 mm or less on a recording material. Meanwhile, if the count of the continuity of pixels does not finish within 11 pixels even if image data of one page is analyzed, it can be seen that there is no image of 0.4 mm or less on the recording material in the image data.

The method for analyzing the continuity of pixels described above may be restated as follows. For each image area, which is a connecting component contained in an image of binary image data, the image area is evaluated whether the image area is wide one such as a filled shape or a narrow one such as a text image by acquiring a number of continuous pixels in crossing the image in a predetermined direction(s), e.g., in a vertical direction and a horizontal direction in the present example. Then, a minimum value of the number of continuous pixels in crossing the image area is defined as the continuity of pixels of the image corresponding to the image area. Note that in a case where a plurality of image areas is contained in image data of one page, a minimum value within the continuity of pixels of the image corresponding to each image area is defined as the continuity of pixels of the image data.

Next, the video controller 30 calculates image density for each image area contained in the image data. That is, the video controller 30 sets a minimum value of the density information of the pixels acquired in Step S13 among the pixels composing the area where the pixels whose toner amount is not 0 continue as the image density of the image area in Step S15.

The video controller 30 transmits information of the continuity of pixels and information of the image density analyzed in Steps S13 through S15 to the control portion 31 in Step S16.

After that, the video controller 30 generates image signals by performing a halftone processing or the like to the YMCK data acquired in Step S12 and by converting an exposure amount of each color into an exposure pattern actually used for each pixel in Step S17. This image signal is transmitted from the video controller 30 to the control portion 31, and the exposure unit 6 executes the exposure process by outputting a laser beam based on the image signal in Step S18.

Flow for Determining Target Fixing Temperature

Figure 6:
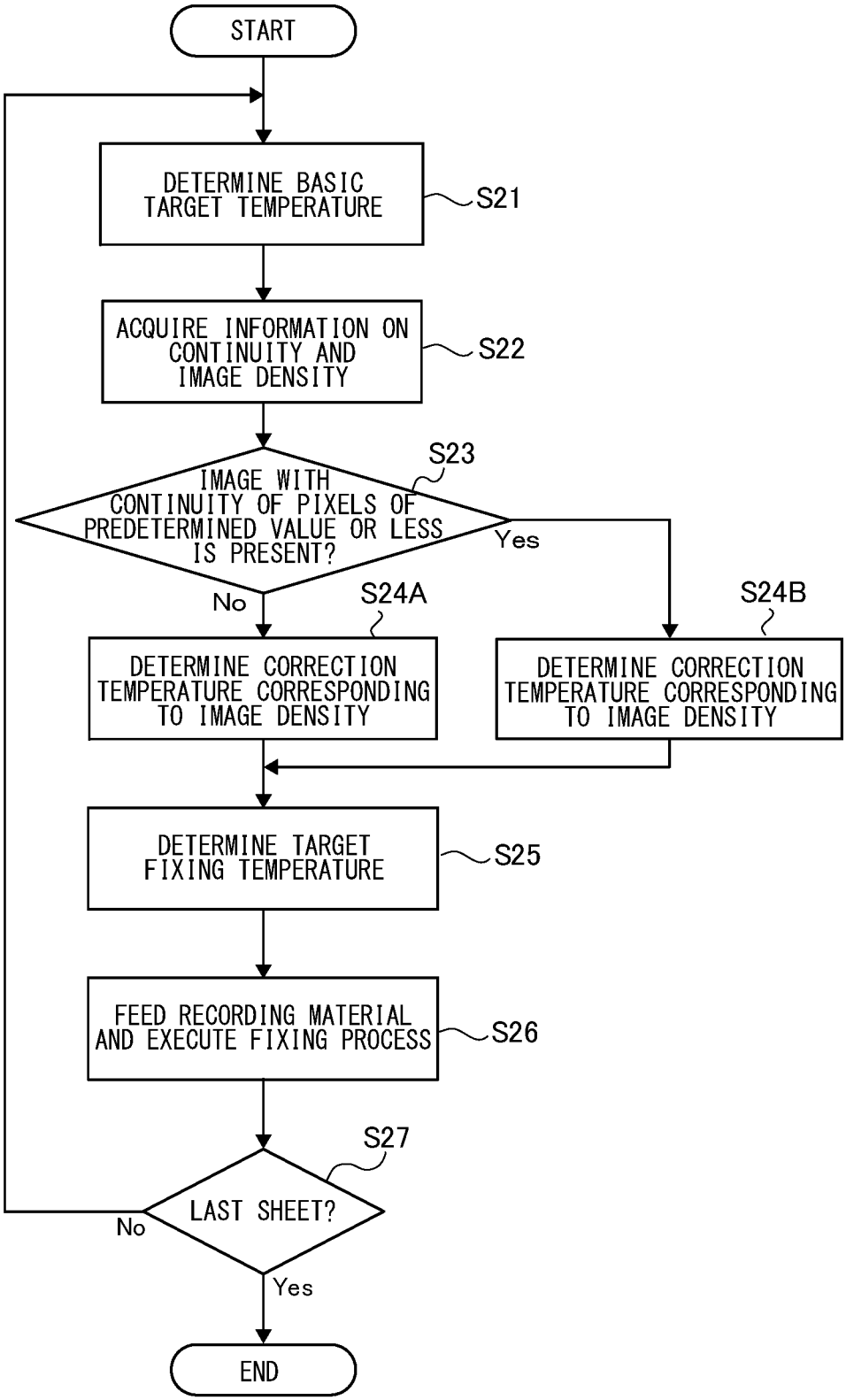
FIG. 6 is a flowchart indicating a flow for determining a target fixing temperature of the first example.

A flow for determining a target temperature of the fixing apparatus F1 will be described below along a flowchart in FIG. 6. The flow described below represents contents of processes executed by the control portion 31 serving as the temperature controller of the present example.

As the video controller 30 receives the PDL data from the host computer, the image forming apparatus starts to prepare an image forming operation. At first, the video controller 30 acquires information such as printing conditions, an ambient temperature of an installed environment, an elapsed time from a previous image forming operation described in the PDL data and determines a basic target temperature T0 of the fixing apparatus F1 in Step S21.

Next, by making reference to analysis results of the PDL data of the video controller 30, the control portion 31 acquires information of a continuity of pixels and information of image density with respect to the image data that is an object of the image forming operation of this time in Step S22. Then, the control portion 31 judges whether the continuity of pixels is equal to or less than the predetermined value D1 in Step S23. The control portion 31 also determines a correction temperature T1 indicating a correction amount to the basic target temperature T0 in accordance to the judgment result in Step S23 and the image density in Step S24A or Step S24B.

In the present example, the predetermined value D1 serving as a threshold value of the continuity of pixels is set at 24 pixels. This value corresponds to about 1.0 mm with resolution of 600 dpi of the image forming apparatus P of the present example and corresponds to a text image of about 30 points or less, through it also depends on a type of a font.

FIG. 7 is a correction temperature determining table for determining the target fixing temperature T. Data indicating corresponding relations among the conditions of the continuity and the image density and the correction temperature in the table is stored in a non-volatile memory area provided in the image forming apparatus P such as the ROM 304 (see FIG. 3) in the video controller 30 for example.

The target fixing temperature T is determined by a value in which the correction temperature T1 is added to the basic target temperature T0 in Step S25. Then, a fixing process is executed in Step S26 while passing the recording material S onto which the toner image has been transferred through the fixing apparatus F1 while controlling the temperature of the fixing apparatus F1 based on the target fixing temperature T determined as above. The controls described above are repeated until outputs of all images specified by the PDL data are completed by Step S27.

As illustrated in the table in FIG. 7, according to the present example, the target fixing temperature T is set high in a case where the image data contains an image with a less continuity of pixels as compared to a case where the image data contains no image with a less continuity of pixels. That is, the control portion 31 serving as the temperature controller sets a target temperature of the fixing apparatus in a case where the image data contains the image with a continuity of pixels equal to or less than the predetermined value to be higher than a target temperature of the fixing apparatus in a case where the image contains no image with the continuity of pixels equal to or less than the predetermined value. This configuration makes it possible to improve durability against erasing.

Still further, if the continuity of pixels is approximately equal, i.e., in a case where the continuity of pixels are classified in the same row in the table in FIG. 7, the target fixing temperature T is set high in a case where the image density is low as compared to a case where the image density is high in the present example. That is, the control portion 31 serving as the temperature controller sets the target temperature of the fixing apparatus such that a value of the target temperature in a case of containing an image with image density of less than a predetermined density, i.e., 100%, is higher than a value of the target temperature in a case of containing no image with image density less than the predetermined density. This configuration makes it possible to further improve the durability against erasing. Note that although the target fixing temperature is changed within three levels including a case where the image density is equal to the predetermined density, i.e., 100%, in the example illustrated in FIG. 7, the target fixing temperature may be controlled within two levels by including the case where the image density is equal to the predetermined value in the upper or lower stage.

Note that in a case where image data of one page contains a plurality of image areas where pixels continue and when the continuity and image density are different among the image areas, a highest value in target fixing temperatures corresponding to respective image areas is set as the target fixing temperature T of that page.

Rubber Eraser

A mechanism of a missing image caused by erasing and required durability will be described here. Erasers are roughly divided into two types. First one is an ordinary rubber eraser whose main component is rubber or resin and used in erasing a line drawn by a pencil for example. Second one is a rubber eraser into which hard filler is added and is used in erasing not only an image drawn by a pencil but also an image which cannot be normally erased such as a line drawn by a ball-point pen. Some of the latter rubber eraser scrapes off an image on a recording material, as well as a surface layer of the recording material.

It is difficult to completely prevent density of a toner image from dropping and a missing image from occurring by erasing by the rubber eraser into which the hard filler harder than the resin composing toner is added. However, it is not desirable that a toner image is easily erased from an aspect of security of preserved document. Accordingly, it is desirable to leave a toner image in a level in which characters are legible or at least preferable to leave erased traces after erasing.

Note that the present example enables to improve the durability against erasing by an eraser, i.e., an erasing tool in general other than the two types of typical rubber erasers described above. For instance, there has been known a rubber cap for a purpose of erasing characters written by a ball-point pen by generating frictional heat by scrubbing a sheet surface and by using ink that becomes transparent by heat.

Difference Between Durability Against Erasing and Other Durability

Practical durability required for the toner image after fixation on the recording material S includes such durability against friction with fingers caused in carrying and aligning the recording material S and against rubbing with another recording material S. Erasing by an eraser is significantly different from rubbing with the other recording material S in degree of adhesion and pressure between rubbing members.

The recording material S, for which a sheet of paper is mainly used, has surface irregularities of around several tens μm of height. Mutual adhesion is not so high when the recording materials S rub with each other. Merely parts of members in point contact rub with each other from an aspect in microns. However, because the rubber eraser has elasticity, the rubber eraser adheres with the surface of the recording material S and the image surface and comes into surface-to-surface contact with the toner image. The rubber eraser is brought into pressure contact and is rubbed with the recording material by a strong force in general. A person applies a force of at least 0.3 kgf or up to about 3.0 kgf in erasing, though it depends on each individual. Accordingly, a strong shearing force may be applied to the toner image in erasing.

Figure 8A:
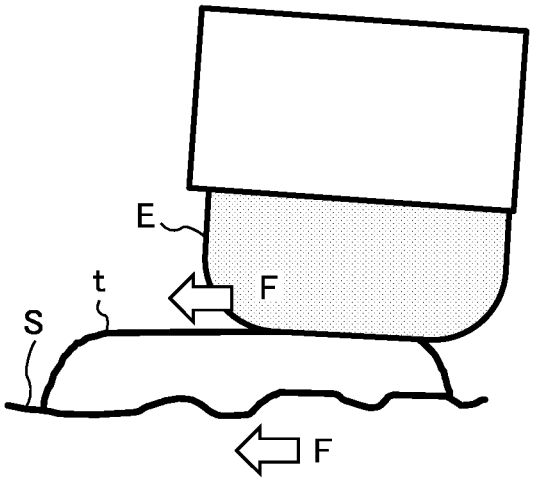
FIG. 8A is a schematic diagram describing a shearing force acting on a toner image when erasing is performed.
Figure 8B:
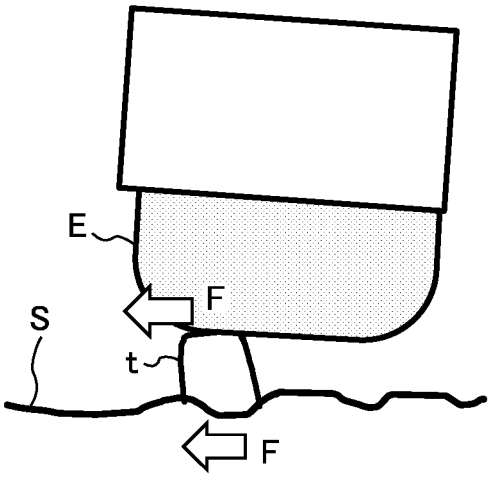
FIG. 8B is a schematic diagram describing the shearing force acting on another toner image when erasing is performed.

FIGS. 8A and 8B are schematic diagrams describing the shearing force applied to the toner image tin erasing by an eraser. When erasing is performed, the shearing force F in a horizontal direction with respect to the recording material S, i.e., in parallel with the recording material S, acts on the surface of the toner image t being in contact with the rubber eraser E as well as on an interface of the recording material S with the toner image t. At this time, for a toner image t having a small contact area with the recording material S within a range being in contact with the rubber eraser as illustrated in FIG. 8B, a shearing force per unit area applied between the toner image t and the recording material S becomes great. That is, an image with a small continuity of pixels has to endure the shearing force with a small area and to assure higher fixability per unit area than an image with a large continuity of pixels.

As described above, the target fixing temperature T is set high in the case of the image with a less continuity of pixels in the present example. That is, the target fixing temperature T is set to be relatively low, within a temperature range appropriate for fixing, by prioritizing the energy-saving property in a case of outputting only the image with a relatively high continuity of pixels. On the other hand, the target fixing temperature T is set to be relatively high in a case where the image with a low continuity of pixels is contained. This configuration makes it possible to fix the toner composing the image with the low continuity of pixels, which is generally weak against erasing, strongly to the recording material S and to assure durability against erasing.

The target fixing temperature T is set high also for an image with image density under 100%, i.e., for a halftone image, as compared to an image with image density of 100% or more due to the following reasons.

In setting the target fixing temperature T based on the continuity of pixels as described above, the degree of continuity is judged based on image data before half-tone processing. If the image density is ignored, the continuity of pixels of a text image is small and the continuity of pixels of an image of a shape is large in general.

Here, while there are several processing methods as the half-tone processing such as dither processing and error diffusion, the continuity of pixels of the toner image t formed finally on the recording material S will become low because the image data in which gradation is continuously changed is converted into a distributive image, i.e., an image in which the gradation is expressed by distribution of presence/absence of dots. That is, even if binarized images have a same level of continuity of pixels, a half-tone image actually formed on a recording material has a continuity of pixels lower than that of a solid image and hence durability thereof against erasing is lowered.

Due to that, the target fixing temperature T of the half-tone image is set to be higher than that of an image with image density of 100% or more. Still further, because a continuity of pixels of an image with a small continuity of pixels before the half-tone processing such as a text image is lowered further by the half-tone processing, the durability against erasing is lowered further. Then, the target fixing temperature T is set further higher when the condition of the continuity of pixels and the condition of the image density are satisfied at the same time, to assure the durability against erasing.

Note that if images have approximately equal continuity of pixels when the images have image density of 100% or more, an image with higher image density has high durability against the rubber eraser. This point may be described as follow.

Hard filler harder than toner resin is added to some rubber eraser, and such rubber eraser has a rubbing force of abrading the toner image t from a surface of an image. The higher the image density and the higher the height of the toner image t, the more the number of times of reciprocation required for erasing increases until the toner image t abrades and the recording material S is exposed. Accordingly, traces of the rubber eraser tend to be dirty and to be left on the recording material S. Meanwhile, an image with low image density and with low toner image t abrades relatively readily. Accordingly, such toner image t tends to be readily scraped out of the recording material S without leaving its trace.

The high target fixing temperature T is applied to an image with low image density as compared to an image with high image density in the present example. Because a degree of melting and binding toner particles with each other increases by increasing the target fixing temperature T, it brings about such an effect that the toner image t hardly abrades.

Experiments

Experiments have been conducted to confirm such effect in a case where the configuration of the present example is applied. A processing speed of the image forming apparatus used in the experiments was 100 mm/s, and a distance (i.e., paper interval) between a preceding recording material S and a following recording material S was 30 mm. A sheet of paper of 80 g/m$^2$ of grammage and a LTR size (216 mm in width and 279 mm in length) which is one of ordinary printing sheets for a laser beam printer was used. The experiments have been carried out by installing the image forming apparatus in an environment of 23° C. of ambient temperature and 50% of humidity.

Because the image forming apparatus of the first example determines the target fixing temperature T in accordance to the correction temperature determining table in FIG. 7 as described above, the target fixing temperature T is set high in a case where the continuity of pixels is low or where the image density is low. In order to compare with the first example, image forming apparatuses for first and second comparative examples were prepared. The image forming apparatus of the first comparative example sets the target fixing temperature T constant regardless of contents of the image data. The image forming apparatus of the second comparative example is set so as to lower the target fixing temperature T, differing from the first example, in a case where the continuity of pixels is low or where the image density is low (see FIG. 9). The image forming apparatuses of the first and second comparative examples are configured to be same with the image forming apparatus of the first example except of the setting of the target fixing temperature T.

The experiments for evaluating fixability of outputted toner images t were carried out by executing image forming operations on the respective image forming apparatuses while changing images to be formed on the recording material S. The followings are images used in the experiments.

- A first experimental image is a solid image of 200% of image density. Margins of 5 mm are provided at a leading edge, a trailing edge, a right edge and a left edge of a page as margin parts. The solid image is formed such that the image density becomes 200% in total by applying four color toners of YMCK to the whole page.
- A second experimental image is a solid image of 100% of image density with the K toner.
- A third experimental image is a text image of 200% of image density. This is a text image in which characters of "ABC" of gothic font of 11 points are repeatedly arranged. The text image is formed such that the image density becomes 200% in total by the four color toners of YMCK.
- A fourth experimental image is a text image of 100% of image density. This is a text image in which characters of "ABC" of gothic font of 11 points are repeatedly arranged. The text image is formed with the image density of 100% by the K toner.

The following evaluation of fixability were made on the images outputted by the respective image forming apparatuses:

- As a first fixability evaluation, it was confirmed whether a defective image, i.e., offset, of the toner image after a fixing operation is present.
- As a second fixability evaluation, it was confirmed whether a missing image occurs by rubbing the recording materials S with each other.
- As a third fixability evaluation, it was confirmed whether a missing image occurs by conducting a rubber eraser test.

The first fixability evaluation in which the defective image (i.e., offset) after the fixing operation is checked will be described. In a case where fixability of the toner image t with the recording material S is not enough, a missing image of missing the toner image t or a defective image called as an offset occurs. The offset is a phenomenon by which the toner image t on the recording material S is transferred onto the fixing film 22 side and is then adhered again at a position deviated from an original position on the recording material S by a length of one round of the fixing film 22. The images after the fixing operation were visually confirmed and determined as follows by the first fixability evaluation:

- OK: No missing image or offset occurs. Or, it is insignificant and is inconspicuous
- N/A (Not Acceptable): Conspicuous missing image or offset has occurred As the second fixability evaluation, rubbing test of the recording materials is conducted in which the recording materials S on which the toner images t have been formed were rubbed with each other, and it was confirmed whether a missing image was present. Specifically, one recording material S on which the toner image t has been formed was fixed, and another recording material was laid thereon and reciprocated and rubbed by 10 times while pressing them with 0.2 kgf. The images after rubbing were visually confirmed and were ranked as follows:

OK: No missing image or offset occurs. Or, it is insignificant and is inconspicuous N/A: Conspicuous missing image or offset has occurred.

As the third fixability evaluation, the rubber eraser test is conducted with conditions as follows. The recording material S was fixed and the rubber eraser was reciprocated by 100 times with a stroke of 50 mm and a speed of one reciprocation per second while pressing the rubber eraser against the recording material S with about 1.0 kgf. The rubber eraser used was PLAST0140 manufactured by Laufer Co. This rubber eraser contains hard filler. The toner images after the test were observed and were ranked as follows:

OK: No missing image occurs. Or, while thin density or a partial missing image occurs, a contour of an image is kept. In a case of a text image, characters can be properly read.

N/A: The contour of the image collapses like a break of a line. In a case of a text image, characters cannot be properly read.

A table in FIG. 10 illustrates results of the experiment. In the image forming apparatus of the first example, all of the evaluation results of the first fixability evaluation, the second fixability evaluation and the third fixability evaluation were OK for all of the first through fourth experimental images. Meanwhile, in the first and second comparative examples, while all of the evaluation results of the first and second fixability evaluations were OK for all of the first through fourth experimental images, the third fixability evaluation, i.e., the erasing test, was N/A for part of the second through fourth experimental images.

The reason why the third fixability evaluation was N/A for the parts of the condition in the first and second comparative examples was because the target fixing temperature T was set at equal or less temperature for those images having less continuity and low image density which are disadvantage in terms of durability against erasing, and durability was in fact insufficient. Meanwhile, it was confirmed that enough fixability was assured even for images disadvantageous in terms of durability against erasing in the first embodiment. It was also possible to enhance the energy-saving property by setting the target fixing temperature T low in a case of containing no image with low continuity or low image density.

Note that while the minimum values of the continuity of pixels and the image density in each image area are set as information of the continuity of pixels and image density of the image of the corresponding page in a case where a plurality of image areas is contained in one page in the present example, other information may be used. For instance, average values of the continuity of pixels and the image density of each image area may be used as information of the continuity of pixels and the image density of the image of the corresponding page.

Still further, numerical values corresponding to a width of a line or a text has been defined as the continuity of pixels in the present example. That is, while the image analyzer for judging the continuity of pixels has counted a number of pixels indicative of that a toner amount is not 0 is continuously arrayed, another analysis method may be used if it enables to judge a degree of continuity of pixels. For example, the degree of continuity of pixels may be judged whether a high frequency component is present when discrete Fourier transform is performed on the binary image data. Still further, a ratio of number of pixels of 1 adjacent to at least one pixel of 0 to a total number of pixels of 1 represents a ratio of a length of a contour line to an area of an image area. Because the larger the ratio, the more the contour line is complicated in the area of the toner image, it can be said that the continuity is low.

Second Example

An image forming apparatus of a second example of the present exemplary embodiment will be described below. The present example is different from the first example in a point that a condition of a type of an object contained in the PDL data is used instead of the condition of the continuity of pixels described in the first example as a condition for changing the target fixing temperature T. Components denoted by common reference signs with those described in the first example have the same configurations and operations with those described in the first example, and parts different from the first example will be described below.

The PDL data is composed of control data and object data as image data. The control data includes setting commands for setting recording material feeding conditions and print processing conditions such as specification of size of a recording material. The object data includes data specifying text images (i.e., text object data), data specifying shape images (i.e., graphic object data), and/or data specifying picture-like images such as photographs (i.e., image object data). The text object data includes commands specifying color, font and size of the text, text data and others.

Receiving the PDL data, the video controller 30 can judge whether the object data contains text data by analyzing the object data. Because the text image has a small continuity of pixels as compared to the shape image and the picture-like image such as a photograph in general, it can be assumed that the image to be formed this time has a small continuity of pixels if the text object data is contained as the object data.

A relatively high image analysis processing is required to analyze the image data pixel by pixel to calculate the continuity of pixels. Accordingly, the video controller 30 will be required to have a relatively high processing performance to continue the image analyzing process without dropping productivity of the image forming apparatus P. It is possible to lower a load as compared to the first example because the target fixing temperature T is judged by the simple method of judging whether the text image is present from the object data in the present example.

Figure 11:
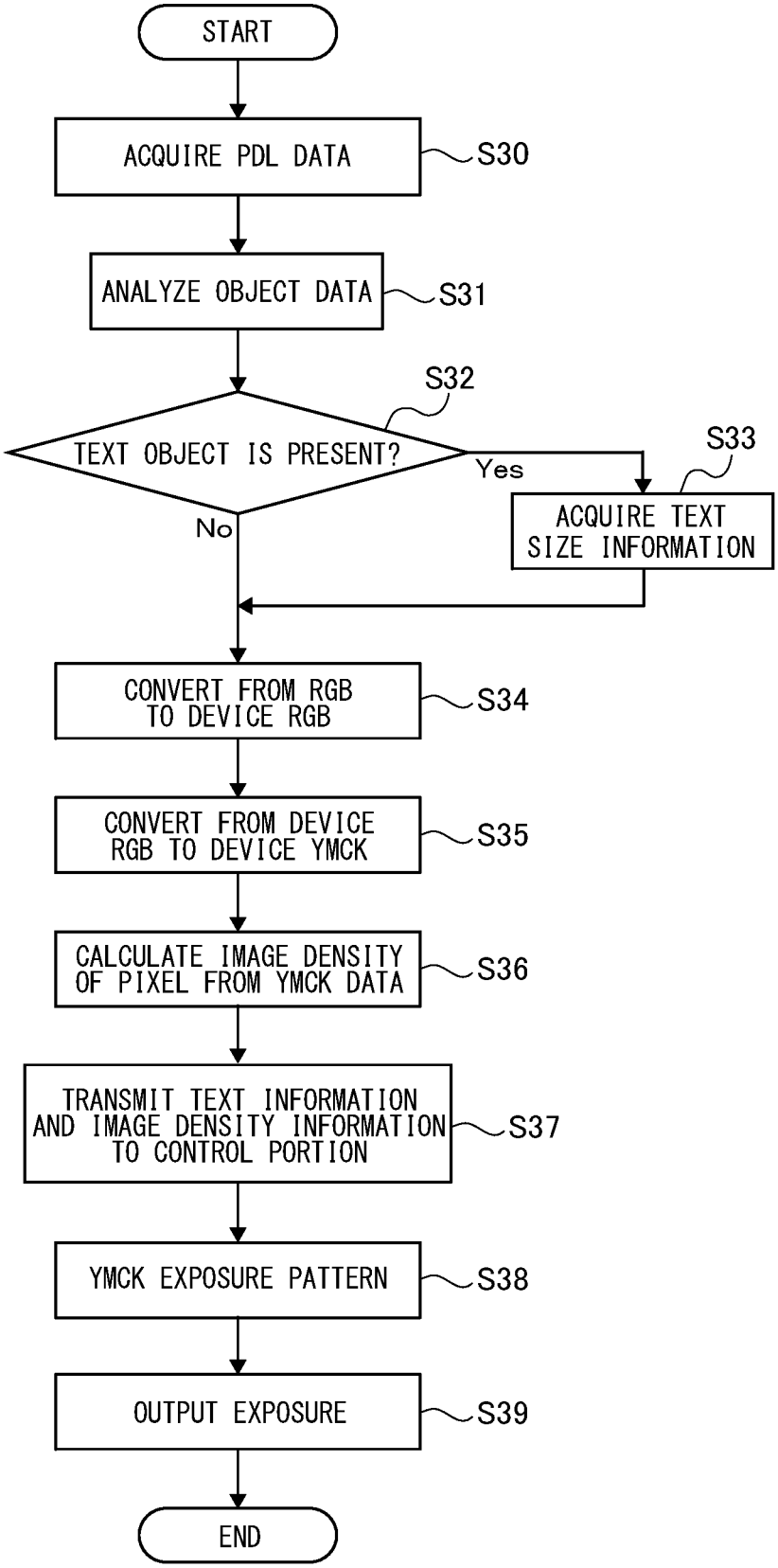
FIG. 11 is a flowchart indicating a processing flow of image data in a second example.

Operations and control methods of the image forming apparatus P of the second example will be described below. FIG. 11 illustrates an image data processing flow executed by the video controller 30. At first, PDL data containing control data and object data is transmitted from the host computer in Step S30. The video controller 30 analyzes the PDL data by extracting the object data contained in one page from the PDL data for each page in Step S31 and judges whether the extracted object data includes text object data in Step S32. If there exists the text object data, the video controller 30 acquires text size information from the text object data in Step S33. A combination of the information whether the text object data is present and the information of the text size will be referred to as "text information" hereinafter.

Because processes in Steps S34 through S39 are the same with the processes in Steps S11 through S13 and S16 through S18 described in FIG. 4 in the first example, their description will be omitted here. Note that, while the information of the continuity of pixels and of the image density are transmitted to the control portion 31 in Step S16, the text information and the information on image density are transmitted to the control portion 31 in Step S37.

Flow in Determining Fixing Target Temperature

A flow for determining a target temperature of the fixing apparatus F1 will be described below along a flowchart in FIG. 12. The flow described below represents contents of processes executed by the control portion 31 serving as the temperature controller of the present example.

As the video controller 30 receives the PDL data from the host computer, the image forming apparatus starts to prepare an image forming operation. At first, the video controller 30 acquires information such as printing conditions, an ambient temperature of an installed environment, an elapsed time from a previous image forming operation described in the PDL data and determines a basic target temperature T0 of the fixing apparatus F1 in Step S41.

Next, by making reference to analysis results of the PDL data of the video controller 30, the control portion 31 acquires the text information related to the image data which is an object of the image forming operation of this time and information of image density in Step S42. Then, the control portion 31 judges whether the text size is equal to or less than a predetermine size D2 in Step S43. The control portion 31 also determines a correction temperature T1 indicating a correction amount to the basic target temperature T0 in accordance to the judgment result in Step S43 and the image density, in Steps S44A or S44B. The predetermined size D2 which is a threshold value of the text size is set to be 30 points in the present example.

FIG. 13 is a correction temperature determining table for determining the target fixing temperature T. Data indicating corresponding relations among the conditions of the text information and the image density and the correction temperature in the table is stored in the non-volatile memory area provided in the image forming apparatus P such as the ROM 304 (see FIG. 3) in the video controller 30 for example.

The target fixing temperature T is determined by a value in which the correction temperature T1 is added to the basic target temperature T0 in Step S45. Then, a fixing process is executed to pass the recording material S onto which the toner image has been transferred through the fixing apparatus F1 while controlling the temperature of the fixing apparatus F1 in accordance with the target fixing temperature T thus determined in Step S46. The controls described above are repeated until outputs of all images specified by the PDL data are completed in Step S47.

As illustrated in the table in FIG. 13, according to the present example, the target fixing temperature T is set high in a case where the PDL data contains data indicating a text image as compared to a case where the PDL data contains no data indicating a text image. That is, the control portion 31 serving as the temperature controller sets a target temperature of the fixing unit such that a value of the target temperature in a case where the image data contains the text image is higher than a case where the image data contains no text image. This configuration makes it possible to improve durability against erasing. It is also possible to improve the energy-saving property by lowering the target fixing temperature T in the case where the image data contains no text image.

Specifically, the target fixing temperature T is set high in a case where a text object of equal to or smaller than a predetermined size with a narrow line width, i.e., equal to or less than 30 points in the case described above, is contained as compared to a case where no text object of less than the predetermine size is contained in the present example. This configuration makes it possible to prioritize the energy-saving property to a case where only large text image, which is relatively strong against erasing because a line width is thick, is contained in outputting text images.

Note that while the present example detects whether a text image is present by analyzing the PDL data, any analyzing unit may be used as long as the unit enables to detect the presence of the text image.

Third Example

An image forming apparatus of a third example of the present exemplary embodiment will be described below. The present example includes a plurality of different modes, i.e., a plurality of fixing modes, for controlling the fixing apparatus F1 and is different from the first example in that a method for setting the target fixing temperature is changed in accordance to the fixing modes. Components denoted by the common reference signs with those described in the first example have the same configurations and operations with those described in the first example, and parts different from the first example will be described below.

In the present example, in a first fixing mode (i.e., a first mode), the target fixing temperature T is set high in a case where an image with low continuity of pixels or low image density is outputted as compared to other cases. Meanwhile, in a second fixing mode (i.e., a second mode), the target fixing temperature T is set low in a case where an image with low continuity of pixels or low image density is outputted as compared to other cases. Note that the fixing mode can be changed manually by a user depending on a use of the image forming apparatus P through a user interface of the image forming apparatus P for example.

FIG. 14A is a correction temperature determining table for determining the target fixing temperature T in the first fixing mode of the present example and FIG. 14B is a correction temperature determining table for determining the target fixing temperature T in the second fixing mode of the present example. The method for determining the target fixing temperature T in the present example is the same with the first example except of that the table in FIG. 14A or FIG. 14B corresponding to setting of the fixing mode is used in Steps S24A and S24B in FIG. 6, so that a description thereof will be omitted here.

In the first fixing mode, the target fixing temperature T is changed by substantially the same method with the first example, to give durability against erasing to the image with low continuity of pixels or low image density. Therefore, the first fixing mode is suitable for an application of preparing an image to be stored permanently as a document such as a contract document and an archive document.

Meanwhile, in the second fixing mode, enough fixability for enduring daily handling is given to an image, even though it may give less durability against erasing than the first fixing mode. Therefore, the second fixing mode is suitable for an application in which an electronically stored document or an image is formed into an actual image to be viewed temporarily.

Either of the fixing modes make it possible to achieve desirable fixability with minimum energy consumption by switching the target fixing temperature T based on analysis results of image data. Note that because the target fixing temperature T is lowered in the second fixing mode in terms of the image with low continuity of pixels and low image density as compared to the first fixing mode, energy consumption can be reduced further as compared to the first fixing mode.

It is possible to improve convenience while achieving both of the durability of an image against the eraser such as the rubber eraser and the energy-saving property by adopting a configuration in which the fixing modes is switched in accordance to its application.

Fourth Example

An image forming apparatus of a fourth example will be described below. The image forming apparatus of the present example is capable of switching color modes in forming an image between a monochrome mode and a full-color mode, and is different from the second example in that a method for setting the target fixing temperature is changed based on setting of the color mode. The components denoted by the common reference signs with those described in the first and second examples have the same configurations and operations with those described in the first and second examples, and parts different from the second example will be described below.

In the present example, the target fixing temperature T is set high in a case of outputting an image in a monochrome mode as compared to a case of outputting an image in a full-color mode. Still further, the target fixing temperature T is set high in a case of outputting an image containing a text image, e.g., a text image with a font size of 30 points or less in particular, as compared to a case of outputting an image containing no text image.

Figure 12:
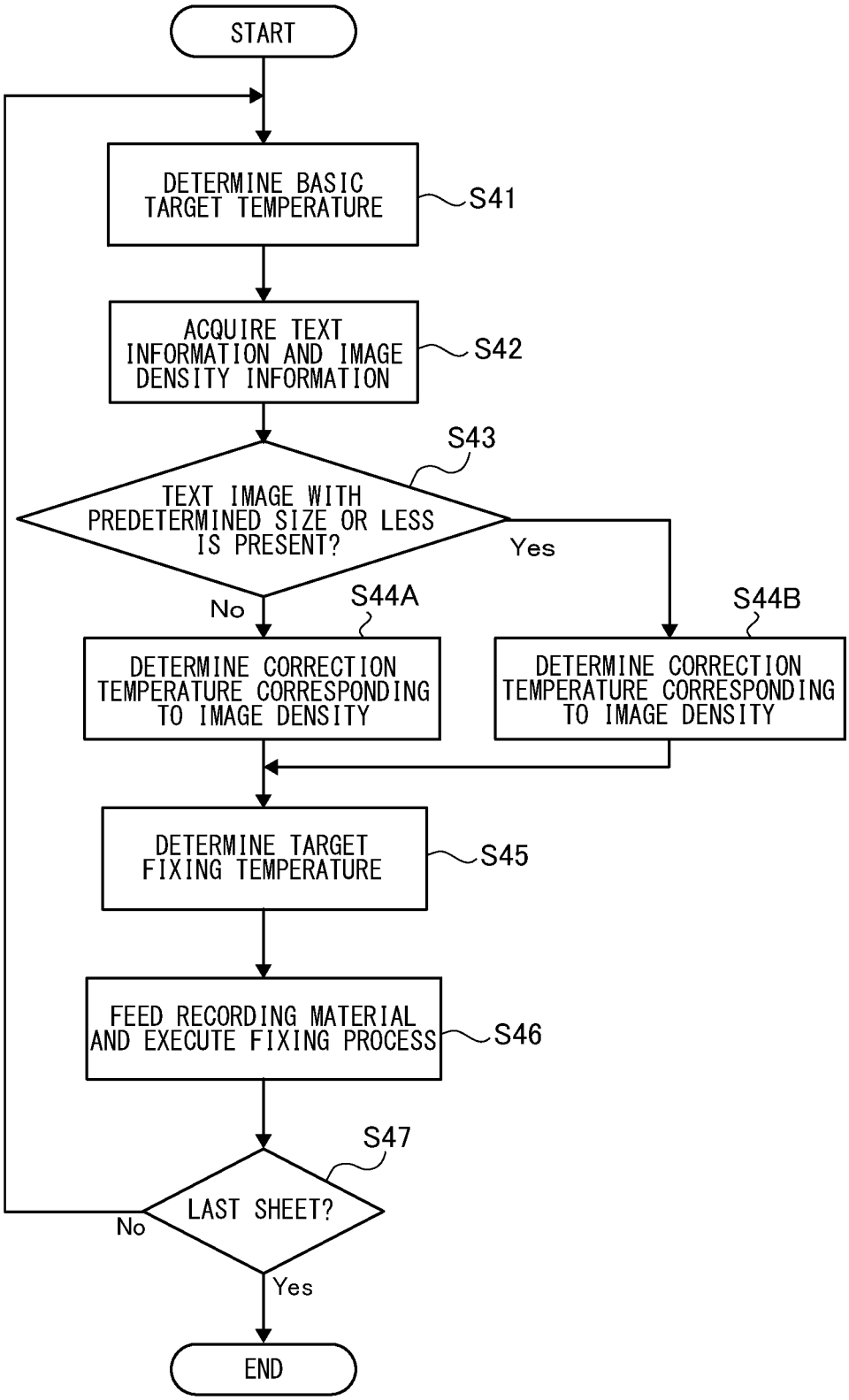
FIG. 12 is a flowchart indicating a flow in determining a target fixing temperature of the second example.

FIG. 15 is a correction temperature determining table for determining the target fixing temperature T in the present example Because the method for determining the target fixing temperature T in the present example is the same with the second example except of that the table in FIG. 15 is used in Steps S44A and S44B in FIG. 12, a description thereof will be omitted here.

The image forming apparatus P capable of forming an image by the four color toners of YMCK as illustrated in FIG. 1 may be arranged so as to switch color modes between a full-color mode using the plurality, i.e., four colors in this example, of toners and a monochrome mode in which an image is formed only by a single color toner. Switching of the color modes may be made by the video controller 30 or the like that automatically judges the color modes depending on color information of image data or by the user who explicitly makes a selection.

In the full-color mode, an image can be formed with image density of up to 400% in principle. However, the image forming apparatus is configured such that maximum image density is set within a range of 200 to 300% in general from aspects of fixability and transfer property.

While an image of a black text can be formed by the K toner with an image density of 100% even in the full-color mode, process black in which other color toners are mixed to the K toner can be used depending on a type of an object. The process black refers to black or color close to black rendered by superimposing a plurality of toners on a recording material. The process black has image density of 150 to 230% for example. The black text may be printed in the process black.

While there is a possibility of using an image with high image density exceeding 100% in the full-color mode, an image is formed with image density always up to 100% in the monochrome mode. Therefore, an image with low image density may be possibly formed in the monochrome mode as compared to the full-color mode, and such image may be possibly disadvantageous as against erasing.

According to the present example, the target fixing temperature T is set high in the monochrome mode as compared to that in the full-color mode. This configuration makes it possible to give enough durability against erasing to the toner image t formed on the recording material in the monochrome mode. Meanwhile, the target fixing temperature T is set relatively low in the full-color mode in which a toner image relatively strong against erasing is assumed to be formed. This configuration makes it possible to improve the energy-saving property while assuring the durability of a toner image against erasing.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-233016, filed on Dec. 24, 2019, which is hereby incorporated by reference herein in its entirety.

What is claimed is:

1. An image forming apparatus comprising:

an image forming unit configured to form a toner image on a recording material based on image data;

a fixing unit configured to heat the toner image formed on the recording material by the image forming unit to fix the toner image to the recording material;

an image analyzer configured to analyze the image data to obtain a value related to image continuity in an image area, wherein the image data includes (i) the image area that is a set of pixels to which toner is applied for forming the toner image and (ii) a non-image area that is a set of pixels to which toner is not applied for forming the toner image, and wherein the value represents a minimum number of continuous pixels belonging to the image area in a line in a main scanning direction or continuous pixels belonging to the image area in a line in a sub scanning direction, among all the lines in the main scanning direction and the subscanning direction within the image data; and a temperature controller configured to set a target temperature based on analysis results of the image analyzer, and to control power supply to the fixing unit so as to maintain a temperature of the fixing unit at the target temperature, the target temperature being set such that a value of the target temperature in a case where the value related to the image continuity is equal to or smaller than a predetermined threshold is higher than a value of the target temperature in a case where the value related to the image continuity is larger than the predetermined threshold.

2. The image forming apparatus according to claim 1, wherein the image analyzer is configured to obtain the value related to the image continuity based on binary image data that is obtained by binarizing the image data.

3. The image forming apparatus according to claim 1, wherein the predetermined threshold is a value corresponding to a 1.0 mm length on the recording material.

4. The image forming apparatus according to claim 1, wherein the temperature controller is configured to switch between a first mode and a second mode, wherein in the first mode, the temperature controller sets the target temperature such that a value of the target temperature in a case where the value related to the image continuity is equal to or smaller than the predetermined threshold is higher than a value of the target temperature in a case where the value related to the image continuity is larger than the predetermined threshold, and wherein in the second mode, the temperature controller sets the target temperature such that a value of the target temperature in a case where the value related to the image continuity is equal to or smaller than the predetermined threshold is not higher than a value of the target temperature in a case where the value related to the image continuity is larger than the predetermined threshold.

5. The image forming apparatus according to claim 4, wherein the first mode is a mode for forming an image having an improved durability compared to an image formed in the second mode.

6. The image forming apparatus according to claim 4, wherein power consumption in the second mode is lower than power consumption in the first mode.

7. The image forming apparatus according to claim 1, wherein the image analyzer is configured to analyze image density of an image contained in the image data, and wherein the temperature controller is configured to set the target temperature based on the value related to the image continuity and the image density such that a value of the target temperature in a first case where the image data contains an image with image density lower than a predetermined density is higher than a value of the target temperature in a second case where the image data contains no image with image density lower than the predetermined density if the value related to the image continuity in the first case is equal to that in the second case.

* * * * *